US005393285A

United States Patent [19]

Fischer, Sr. et al.

[11] Patent Number: 5,393,285

[45] Date of Patent: Feb. 28, 1995

[54] EXERCISE APPARATUS

[75] Inventors: Kenneth A. Fischer, Sr., Framingham; David L. Landay, Boston; Frederick R. Greer, Abington; Kenneth W. Pratt; Michael K. Pratt, both of Ware, all of Mass.

[73] Assignee: Mohawk Sports, Inc., Milford, Mass.

[21] Appl. No.: 969,094

[22] Filed: Oct. 30, 1992

[51] Int. Cl.[6] ..... A63B 21/075

[52] U.S. Cl. ..... 482/108; 482/106; 482/111

[58] Field of Search ..... 482/106, 107, 108, 111, 482/74; 446/267

[56] References Cited

U.S. PATENT DOCUMENTS

| | | | |
|---|---|---|---|
| 3,334,899 | 8/1967 | Bosko et al. | 482/108 |
| 3,756,592 | 9/1973 | Johnson . | |
| 3,843,117 | 10/1974 | Johnson . | |
| 4,218,057 | 8/1980 | Wilson | 482/74 |
| 4,278,248 | 7/1981 | Kifferstein | 482/74 |
| 4,378,113 | 3/1983 | Piccini . | |
| 4,659,078 | 4/1987 | Blome . | |
| 4,913,422 | 4/1990 | Elmore et al. | 482/106 |

*Primary Examiner*—Richard J. Apley
*Assistant Examiner*—Lynne A. Reichard
*Attorney, Agent, or Firm*—Fish & Richardson

[57] ABSTRACT

An exercise device for has a rigid body defining a chamber, at least one first fluid mass disposed to move within the chamber in response to movement of the rigid body during exercise, thereby increasing the effective mass of the device by dynamic movement of the fluid mass during rhythmic exercise, one or more handles for gripping of the device during exercise, and a set of one or more weight adjusting elements that can be removably attached in order to adjust the static base weight of the exercise device. Exercise devices may be constructed for use of one hand or two hands.

12 Claims, 6 Drawing Sheets

EXERCISE APPARATUS

BACKGROUND OF THE INVENTION

The invention relates to exercise devices.

It has been known in exercise to seek enhanced results by use of devices of the type consisting of a hollow body containing a dynamic volume of fluid. For example, Johnson U.S. Pat. No. 3,756,592 and U.S. Pat. No. 3,843,117 describe an exercise apparatus consisting of a hollow, rigid containing a fluent mass, e.g. sand, with handles and a method for use of such a device by women after child birth. Piccini U.S. Pat. No. 4,378,113 describes a similar device consisting of a hollow club into which a volume, e.g., of water is introduced and a method for use of the device by baseball players for warming-up wrists. Blome U.S. Pat. No. 4,659,078 describes a sling-like exercise device defining a flexible, fluid-filled enclosure for dynamically exercising muscles.

SUMMARY OF THE INVENTION

According to the invention, an exercise device comprises a rigid body defining a first chamber having a first predetermined volume, a first fluid mass disposed within the first chamber, the first fluid mass having a second predetermined volume which is less than the first predetermined volume, and the first fluid mass being adapted to move within the chamber in response to movement of the rigid body during exercise, handle means for gripping the exercise device during exercise, and a set of one or more weight adjusting elements, the exercise device further comprising means for removable attachment of the weight adjusting elements to the device, whereby the exercise device has a static base weight adjustable by the user by selection of the weight adjusting elements for attachment to the exercise device.

Preferred embodiments of the invention may include one or more of the following additional features. The exercise device defines at least one weight adjusting cavity sized to removably retain a weight adjusting element therein.

In one preferred embodiment of an exercise device of the invention, e.g. suitable for use of two hands, the rigid body comprises an elongated cylinder having a side wall and opposed end walls, the exercise device further comprises a pair of end caps attached at the end walls of the rigid body, and the handle means comprises a pair of handle elements, each handle element attached to an outer surface of an end cap. Preferably, the weight adjusting cavity is defined by an end cap. More preferably, the end cap further comprises a cover removably attachable to secure a weight adjusting element within the cavity. The outer surfaces of the end caps are convex surfaces. The handle element comprises a strap adapted for adjustable attachment across a user's hand gripped upon the convex surface of the end cap.

In another preferred embodiment of an exercise device of the invention. e.g. suitable for use of one hand, the rigid body comprises an elongated, arcuate member having a side wall, a first end and a second end, and the handle means comprises an elongated handle end cap member extending between the first and second ends and defining a handle surface. Preferably, the weight adjusting cavity is defined by the handle end cap member, which further comprises a cover removably attachable to secure a weight adjusting element within the weight adjusting cavity.

Preferred embodiments of the invention may also include one or more of the following additional features. The rigid body is formed of translucent or transparent material, whereby movement of fluid within the first chamber may be observed during exercise. Preferably, a second fluid mass is also disposed within the first chamber, the first fluid mass and the second fluid mass being substantially immiscible and, more preferably, having contrasting visual appearance. The exercise device further comprising baffle elements arranged within the first chamber in a manner to retard movement of fluid therewithin.

Objectives of this invention include providing exercise devices having a base weight that is adjustable to suit the user or exercise routine, and in which rhythmic movement of the device causes motion of a volume of fluid contained within the device, the dynamic action of the moving fluid serving to oppose change in direction of movement of the device for an enhanced exercise experience. Exercise devices suitable for use with one hand may be provided, and devices suitable for use with both hands may also be provided. The body of the device containing the fluid may be clear to allow the user to observe the motion of the fluid. Also, two or more immiscible fluids, e.g. of contrasting color or appearance, may be employed.

These and other features and advantages will be seen from the following description of a presently preferred embodiment, and from the claims.

DESCRIPTION OF THE PREFERRED EMBODIMENT(S)

Figure 1:
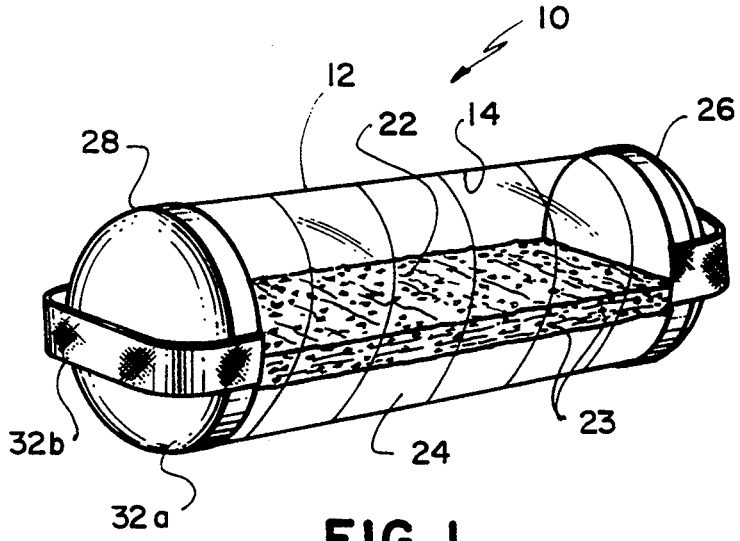
FIG. 1 is a perspective view of one embodiment of an exercise device of the invention.
Figure 2:
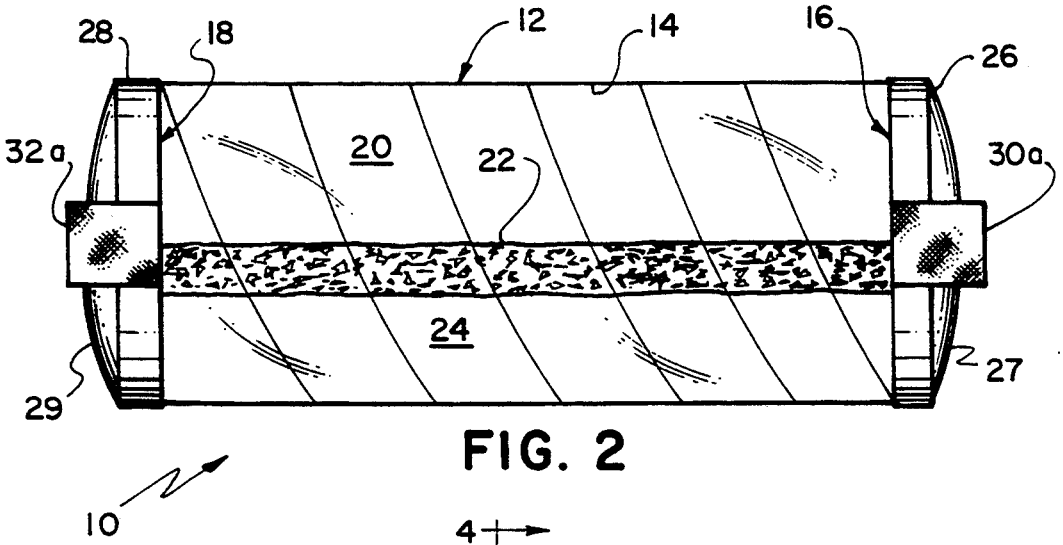
FIG. 2 is a side elevational view of the exercise device of FIG. 1.
Figure 3:
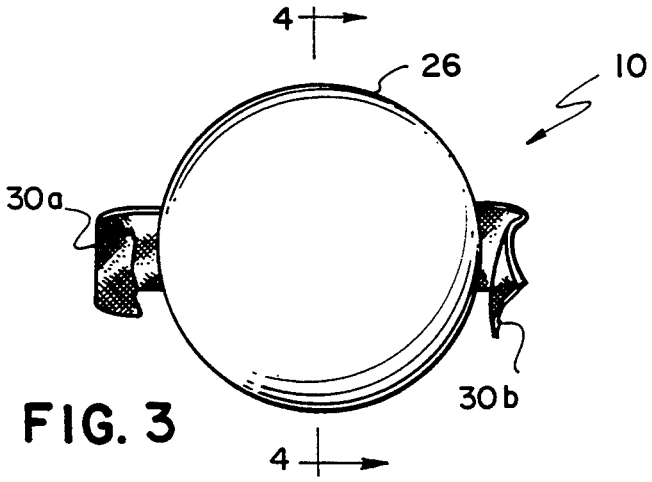
FIG. 3 is an end elevational view of the exercise device of FIG. 1.

Referring to FIGS. 1–3, in a first embodiment, an exercise device 10 of the invention for use with two hands has an elongated cylindrical body 12 with a side wall 14 and end walls 16, 18. The body 12 defines a hollow chamber 20 of predetermined volume, and disposed therewithin is a fluid mass 22, the fluid mass having a volume that is less than that of the chamber, thereby to permit movement of the mass 22 within the chamber in response to exercise motion, as will be described more fully below.

In the preferred embodiment, in order to alleviate the level of boredom that often comes with extended periods of exercise, the body 12 is formed of a transparent or translucent material, e.g. poly vinyl chloride (PVC), high impact polystyrene or other suitable polymeric material, so that motion of the fluid mass, e.g. colored water, within the body can be observed during exercise. The fluid mass 22 visible within the chamber. 20 may also be brightly colored or contain glitter or colored particles 23 (e.g. MYLAR® or other plastic, metal foil or other suitable material) for the same purpose. Also, a second fluid mass 24 may be provided within the chamber 20, the second fluid having a contrasting visual appearance to and being substantially immiscible with the first fluid mass (e.g., the second fluid mass may be clear or colored salad oil or the like), thus creating a visual effect during exercise similar to that of popular desk-top wave machines.

Referring again to FIGS. 1–3, the exercise device 10 further includes end caps 26, 28 that are attached upon opposite ends of the rigid body 12, e.g. by engagement of annular ridge 13 defined by body 12 in corresponding annular groove 25 defined by end caps 26, 28. The ends caps, formed of brightly colored plastic material, preferably matching or contrasting the color of the fluid mass 22, have convex end surfaces 27, 29 and strap sets **30*a*/30*b* and 32*a*/32*b***, Joined by hook-and-loop-type fasteners, are provided for adjustable attachment across a user's hand comfortably gripped upon the convex surfaces of the end cap during exercise.

The effective mass of the exercise device 10 during dynamic exercise varies as a result of momentum of the fluid mass 22 within the chamber 20, which must be overcome to reverse the movement of the device during a rhythmic exercise motion. However, the exercise device 10 has a base static weight (resulting from the mass of the elements Just described) which is fixed. According to the present invention, it is possible also to quickly adjust the base static weight of the device as desired by a particular user and/or for a particular exercise routine.

Figure 4:
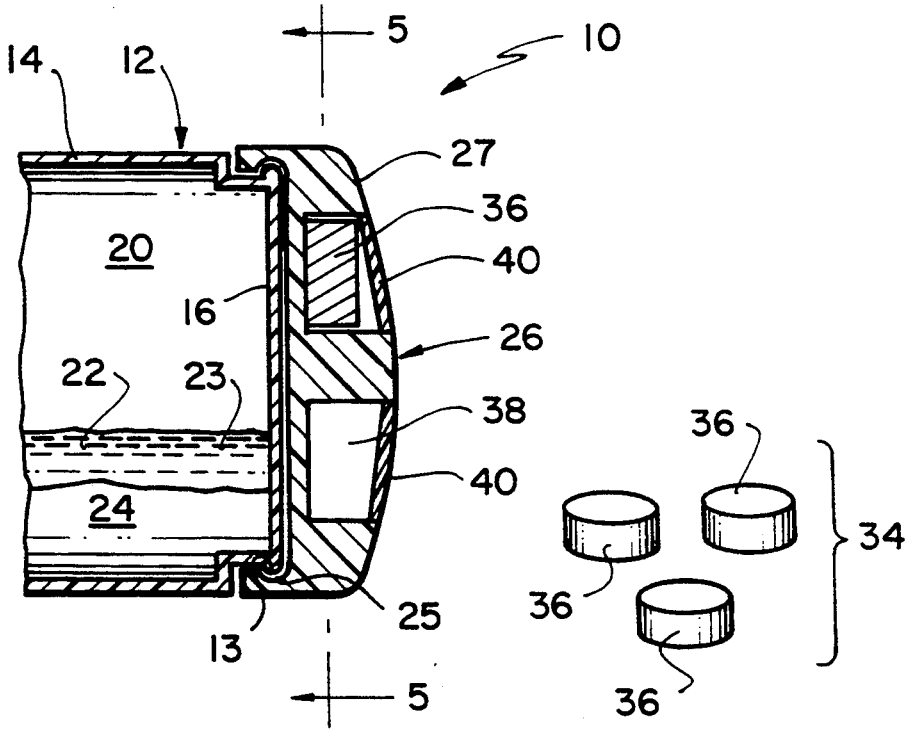
FIG. 4 is a side section view of the exercise device taken at the line 4—4 of FIG. 3.
Figure 5:
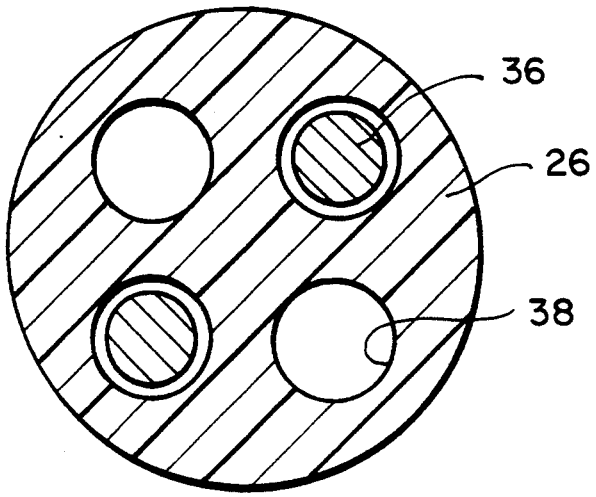
FIG. 5 is an end section view of the exercise device taken at the line 5—5 of FIG. 4.

Referring now also to FIGS. 4 and 5, the exercise device 10 further includes a set 34 of weight adjusting elements 36 and the end caps 26, 28 each define one or more cavities 38 (e.g. four cavities are shown in each end cap) sized to receive a weight adjusting element. The cavities 38 are secured, e.g. by threaded engagement, by a cover 40 disposed thereupon. The static base weight of the exercise device 10 is quickly adjusted by the user by adding or removing weight elements 36, which may be provided for a range of weights, to the cavities 38, with the weights secured in place by covers 40.

Figure 6:
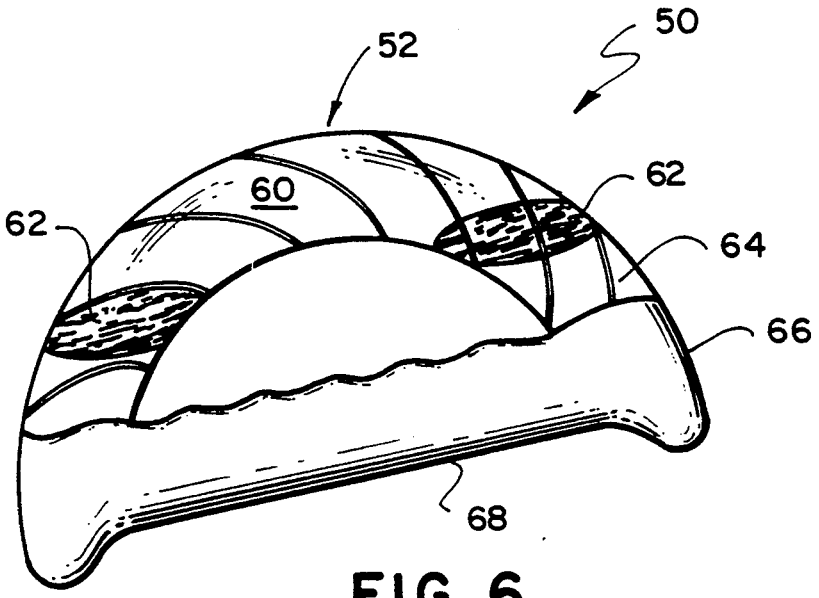
FIG. 6 is a perspective view of another embodiment of an exercise device of the invention.
Figure 7:
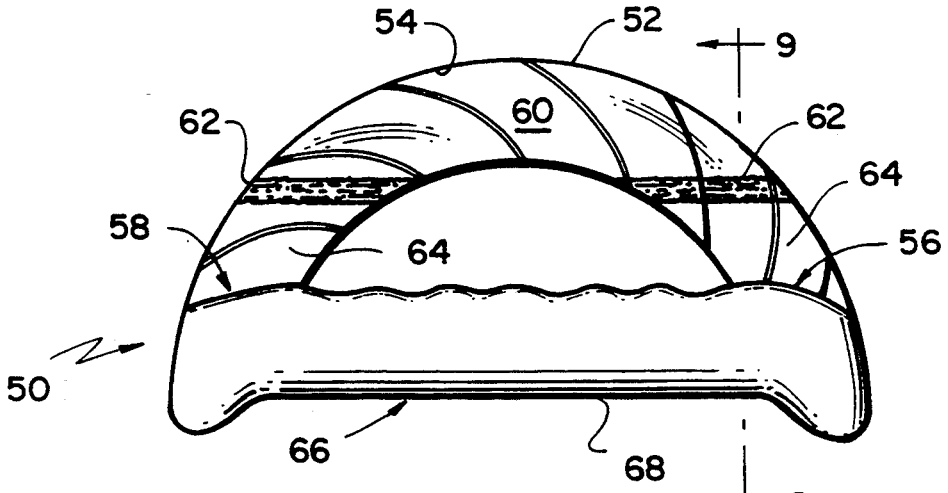
FIG. 7 is a side elevational view of the exercise device of FIG. 6.
Figure 8:
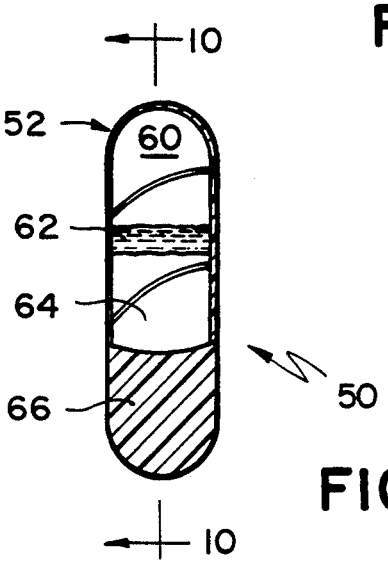
FIG. 8 is an end elevational view of the exercise device of FIG. 6.

Referring now to FIGS. 6–8, in another embodiment of an exercise device 50 for use with one hand (either alone or in pairs) has an elongated arcuate body 52 with a side wall 54 and ends 56, 58. The body 52 defines a hollow chamber 60 of predetermined volume, and disposed therewithin is a fluid mass 62, the fluid mass again having a volume that is less than that of the chamber, thereby to permit movement of the mass 62 within the chamber in response to exercise motion.

Again, in the preferred embodiment, in order to alleviate the level of boredom that often comes with extended periods of exercise, the body 52 is formed of a transparent or translucent material so that motion of the fluid mass within the body can be observed during exercise, and the fluid mass may also be brightly colored or contain glitter or colored particles for the same purpose. A second fluid mass 64 may also be provided within the chamber 60.

The exercise device 50 further includes a handle end cap member 66 extending between attachment upon the ends 56, 58 of the rigid body 52. The handle end cap member 66, formed of brightly colored plastic material, provides a handle surface 68 sized to be gripped comfortably by a user's hand during exercise.

Figure 9:
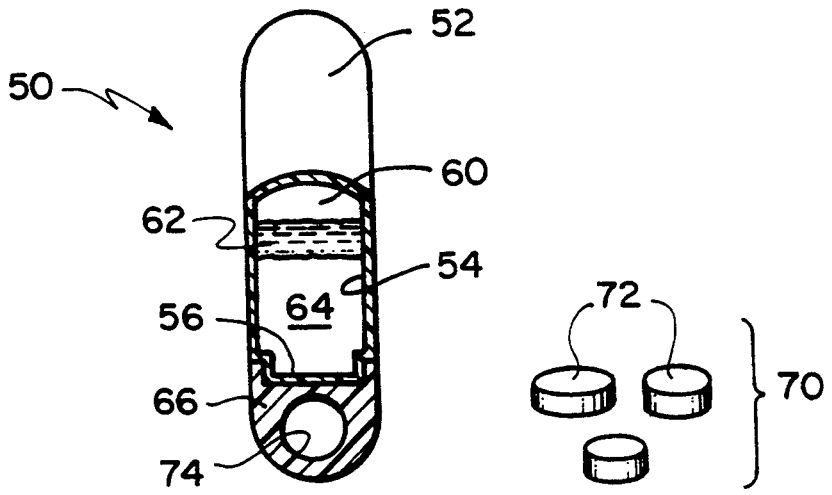
FIG. 9 is a side section view of the exercise device taken at the line 9—9 of FIG. 7.
Figure 10:
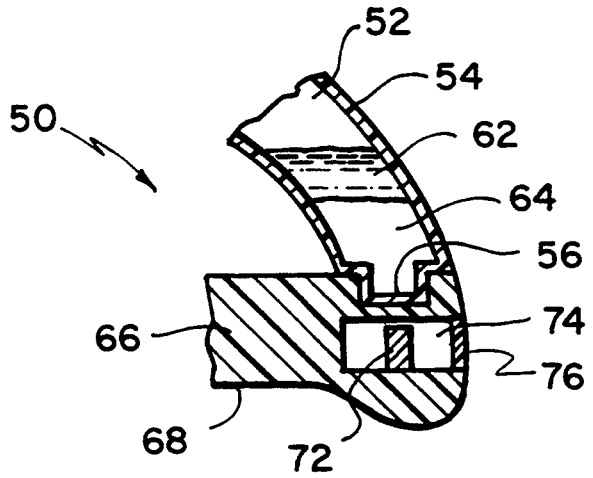
FIG. 10 is an end section view of the exercise device taken at the line 10—10 of FIG. 8.
Figure 11A:
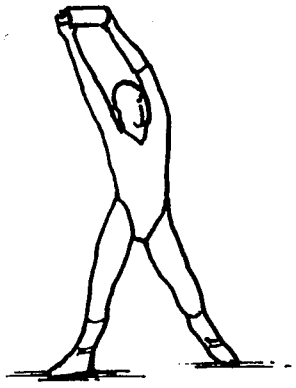
FIGS. 11*a*–11*c*, 12*a*–12*d*, 13*a*–13*c* and 14*a*–14*c* are respective, somewhat diagrammatic, sequential views of exercises employing the exercise device of FIG. 1.
Figure 11B:
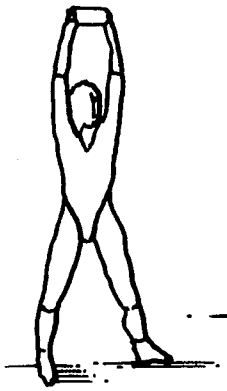
Figure 11C:
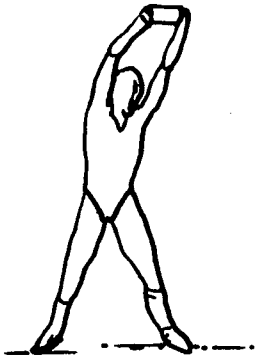
Figure 12A:
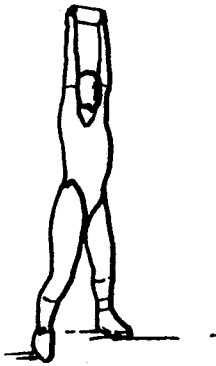
Figure 12B:
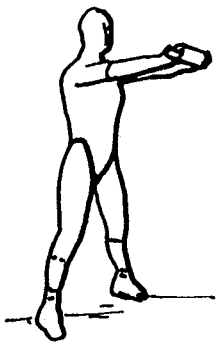
Figure 12C:
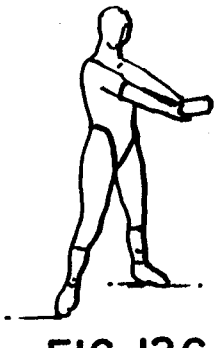
Figure 12D:
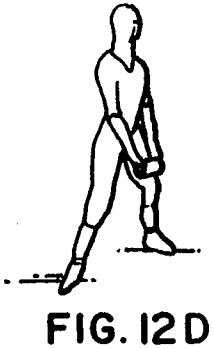
Figure 13A:
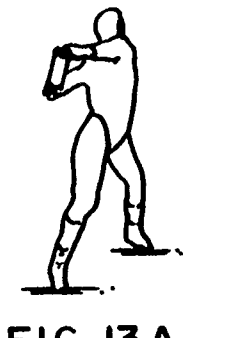
Figure 13B:
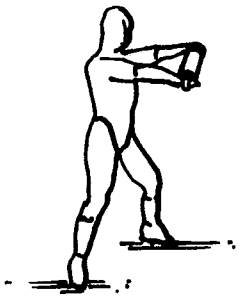
Figure 13C:
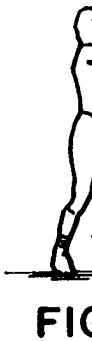
Figure 14A:
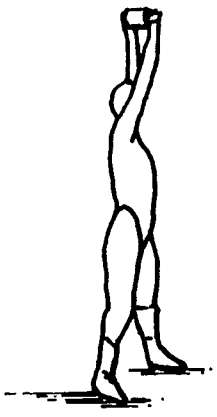
Figure 14B:
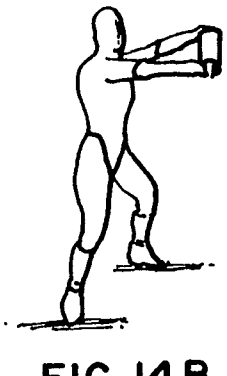
Figure 14C:
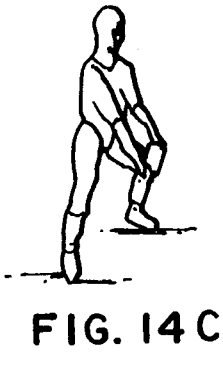
Figure 15A:
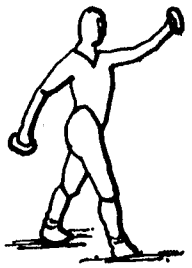
FIGS. 15*a*–15*c*, 16*a*–16*c*, 17*a*–17*c* and 18*a*–18*b* are respective, somewhat diagrammatic, sequential views of exercises employing the exercise device of FIG. 6.
Figure 15B:
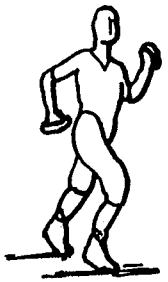
Figure 15C:
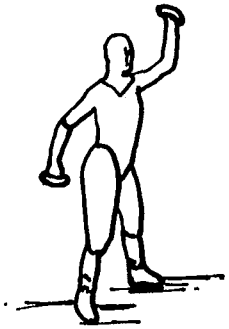
Figure 16A:
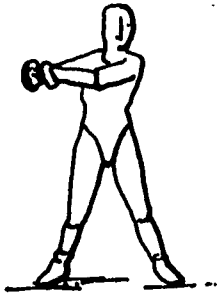
Figure 16B:
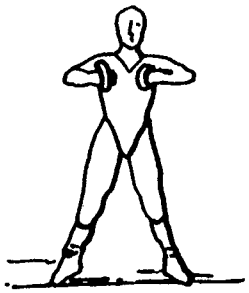
Figure 16C:
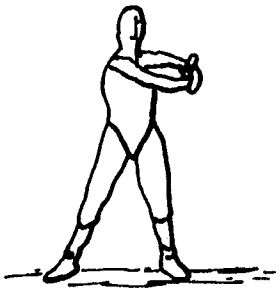
Figure 17A:
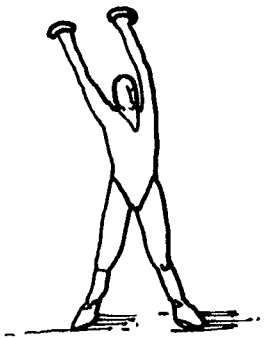
Figure 17B:
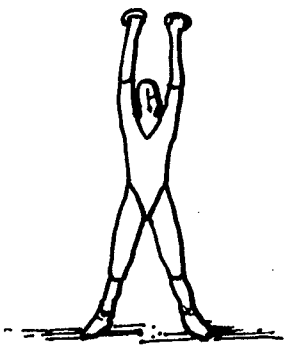
Figure 17C:
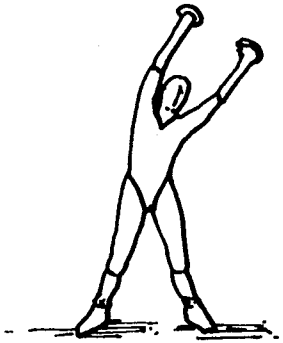
Figure 18A:
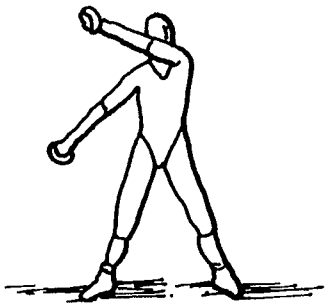
Figure 18B:
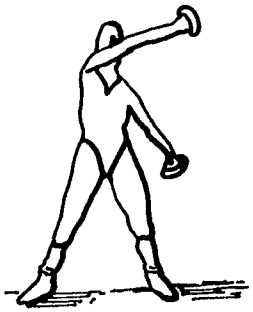

Referring now also to FIGS. 9 and 10, the exercise device 50 also includes a set 70 of weight adjusting elements 72 and the handle end cap member 66 defines cavities 74 (e.g. at each end of member 66) sized to receive a weight adjusting element. The cavities 74 are similarly secured by a threaded cover 76 disposed thereupon. The static base weight of the exercise device 50 is thus quickly adjusted by the user by adding or removing weight elements 72, provided for a range of weights, to the cavities 74.

FIGS. **11*a*–11*c*, 12*a*–12*d*, 13*a*–13*c* and 14*a*–14*c* depict examples of exercises that might be performed using the two hand exercise device 10. Similarly, FIGS. 15*a*–15*c*, 16*a*–16*c*,17*a*–17*c* and 18*a*–18*b* depict examples of exercises that might be performed using the one hand exercise device 50**.

Other embodiments are within the following claims

What is claimed is:

1. An exercise device comprising:

a rigid body defining a first chamber having a first predetermined volume, a first fluid mass disposed within said first chamber, said first fluid mass having a second predetermined volume, said second predetermined volume being less than said first predetermined volume, and said first fluid mass being adapted to move within said chamber in response to movement of said rigid body during rhythmic exercise, at least one handle for gripping of said exercise device during exercise, and a set of one or more weight adjusting elements, said exercise device defining at least one weight adjusting cavity sized to removably retain one or more weight adjusting elements of said set of weight adjusting elements therein and said exercise device further comprising means for removable attachment of one or more of said weight adjusting elements to said device, whereby said exercise device has a static base weight adjustable by the user by selection of said weight adjusting elements for attachment to said exercise device.

2. The exercise device of claim 1 wherein said rigid body comprises an elongated cylinder having a side wall and opposed end walls, said exercise device further comprises a pair of end caps attached at said end walls of said rigid body, and said handle comprises a pair of handle elements, each said handle element attached to an outer surface of a said end cap.

3. The exercise device of claim 2 wherein said at least one weight adjusting cavity is defined by a said end cap.

4. The exercise device of claim 3 wherein said end cap further comprises a cover removably attachable to secure a said weight adjusting element within a said weight adjusting cavity.

5. The exercise device of claim 2 wherein said outer surfaces of said end caps are convex surfaces.

6. The exercise device of claim 5 wherein said handle element comprises a strap adapted for adjustable attachment across a user's hand gripped upon said convex surface of said end cap.

7. The exercise device of claim 1 wherein said rigid body comprises an elongated, arcuate member having a side wall, a first end and a second end, and said handle comprises an elongated handle end cap member extending between said first end and said second end and defining a handle surface.

8. The exercise device of claim 7 wherein said at least one weight adjusting cavity is defined by said handle end cap member.

9. The exercise device of claim 8 wherein said handle end cap member further comprises a cover removably attachable to secure a said weight adjusting element within a said weight adjusting cavity.

10. The exercise device of claim 1 wherein said rigid body is formed of translucent or transparent material, whereby movement of fluid within said first chamber may be observed during exercise.

11. The exercise device of claim 10 further comprising a second fluid mass disposed within said first chamber, said first fluid mass and said second fluid mass being substantially immiscible.

12. The exercise device of claim 11 wherein said first fluid mass and said second fluid mass have contrasting visual appearance.

* * * * *